US010000353B2

(12) United States Patent
Prinsen

(10) Patent No.: US 10,000,353 B2
(45) Date of Patent: Jun. 19, 2018

(54) AIR VORTEX ASSISTED SHEET FLIPPING DEVICE

(71) Applicant: OCÉ-TECHNOLOGIES B.V., Venlo (NL)

(72) Inventor: Kevin H. J. R. Prinsen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 42 days.

(21) Appl. No.: 15/347,977

(22) Filed: Nov. 10, 2016

(65) Prior Publication Data

US 2017/0057772 A1 Mar. 2, 2017

Related U.S. Application Data

(63) Continuation of application No. PCT/EP2015/061469, filed on May 22, 2015.

(30) Foreign Application Priority Data

May 27, 2014 (EP) ..... 14170017

(51) Int. Cl.
*B65H 29/24* (2006.01)
*B65H 15/00* (2006.01)
(Continued)

(52) U.S. Cl.
CPC ..... *B65H 29/246* (2013.01); *B65H 15/00* (2013.01); *B65H 29/22* (2013.01); *B65H 29/40* (2013.01);
(Continued)

(58) Field of Classification Search
CPC ..... B65H 15/00; B65H 29/22; B65H 29/24; B65H 29/246–29/248; B65H 29/40;
(Continued)

(56) References Cited

U.S. PATENT DOCUMENTS 4,027,580 A 6/1977 Sundin
4,466,605 A * 8/1984 Leuthold ..... B65H 29/243 181/211
(Continued)

FOREIGN PATENT DOCUMENTS

DE 10 2005 039 433 A1 2/2007
FR 2 760 733 B1 5/1999
WO WO 2011/064220 A1 6/2011

*Primary Examiner* — Prasad V Gokhale
(74) *Attorney, Agent, or Firm* — Birch, Stewart, Kolasch & Birch, LLP

(57) ABSTRACT

A sheet flipping device includes a receiving member for receiving a sheet, a flipping volume being the volume which in operation is defined by the flipping movement of the sheet, and a flipping element for flipping the sheet around an axis of rotation within the flipping volume onto the receiving member. The sheet flipping device further includes an air vortex ring generator having an air vortex ring exit nozzle defining a translational direction of a generated air vortex ring when the generated vortex ring is in operation generated from the air vortex ring exit nozzle. The air vortex ring generator is mounted such that in operation the sheet is urged onto the receiving member by the air vortex ring during the flipping motion of the sheet through the flipping volume. A sheet stacking device and a printing apparatus include the sheet flipping device.

8 Claims, 5 Drawing Sheets

(51) Int. Cl.
*B65H 29/40* (2006.01)
*B65H 29/22* (2006.01)
*B65H 29/52* (2006.01)

(52) U.S. Cl.
CPC ..... *B65H 29/52* (2013.01); *B65H 2301/333* (2013.01); *B65H 2301/33224* (2013.01); *B65H 2301/4212* (2013.01); *B65H 2404/651* (2013.01); *B65H 2406/122* (2013.01); *B65H 2406/131* (2013.01); *B65H 2801/06* (2013.01)

(58) Field of Classification Search
CPC .... B65H 2301/333; B65H 2301/44765; B65H 2404/1114; B65H 2404/651; B65H 2406/10; B65H 2406/111; B65H 2406/1132; B65H 2406/11325; B65H 2406/12; B65H 2406/121; B65H 2406/1211; B65H 2406/122; B65H 2406/1222; B65H 2404/2406; B65H 2404/10; B65H 2404/111; B65H 2404/1132; B65H 2404/11325; B65H 2404/12; B65H 2404/121; B65H 2404/1211; B65H 2404/122; B65H 2404/1222
See application file for complete search history.

(56) References Cited

U.S. PATENT DOCUMENTS 8,936,240 B2 * 1/2015 Hoshino ..... G03G 15/6552 271/211
2005/0280198 A1 * 12/2005 Laluk ..... B65H 29/40 271/94
2011/0187038 A1 * 8/2011 Heise ..... B65H 15/00 271/3.11
2012/0267845 A1 * 10/2012 Rutten ..... B65H 29/246 271/186
2015/0300385 A1 * 10/2015 Akagi ..... F15D 1/009 137/808

* cited by examiner

PRIOR ART

PRIOR ART

AIR VORTEX ASSISTED SHEET FLIPPING DEVICE

Cross Reference to Related Applications:

This application is a Continuation of PCT International Application No. PCT/EP2015/061469, filed on May 22, 2015, which claims priority under 35 U.S.C. 119(a) to Patent Application No. 14170017.9, filed in Europe on May 27, 2014, all of which are hereby expressly incorporated by reference into the present application.

FIELD OF THE INVENTION

The invention pertains to a sheet flipping device, comprising a receiving member for receiving a sheet, a flipping volume being the volume which in operation is defined by the flipping movement of the sheet, a flipping element for flipping the sheet around an axis of rotation within the flipping volume onto the receiving member. The invention also relates to a sheet stacking device and a printing apparatus comprising such a sheet flipping device.

BACKGROUND ART

A device of this kind is described in FR 2 760 733. The device uses a flipping wheel to stack sheets on a receiving member in a flipped orientation. The flipping wheel comprises slits at its circumference to accommodate portions of a sheet. An abutment is provided to release the sheets from the slit onto the receiving member.

However, it is a disadvantage of this known device that certain types of sheets, in particular floppy sheets with low stiffness in the direction of rotation, do not roll out correctly onto the receiving member, resulting in a less orderly stack or may even result in device blocks, such as paper jams.

It is further known to use fans to generate an air flow to assist rolling out of a sheet during its flipping motions onto the receiving member of such a sheet flipping device.

However, the air flow needed to assist in particular larger and thinner floppy sheets, can have a detrimental effect on stacking quality of a stacking device in which such a flipping device may be mounted.

SUMMARY OF THE INVENTION

In a first aspect of the present invention, a sheet flipping device is provided which further comprises an air vortex ring generator having an air vortex ring exit nozzle defining a translational direction of a generated air vortex ring when said generated vortex ring is in operation generated from the air vortex ring exit nozzle, the air vortex ring generator is mounted such that in operation the sheet is urged onto the receiving member by the air vortex ring during the flipping motion of the sheet through the flipping volume. It is observed that the implementation of such an air vortex ring generator increases the reliability of the flipping device as a result of better roll out of flipped sheets. The air flow through the flipping volume can be smaller in comparison to fan based air flow assistance. In general air vortex rings are toroid shaped flows of air generated in an air vortex ring generator.

In another embodiment of the device according to the invention the translational direction of the generated vortex ring extends substantially from the flipping element towards the flipping volume. In general, the flipping element takes the leading edge of a sheet and turns it towards the receiving member, while the trailing portion of the sheet follows and easily bends away from the receiving member. This could contribute to a decreased stacking quality if the impulse of the bending of the trailing portion of the sheet urges the sheet to move the sheet out of its intended orientation on top of the stack on the receiving member. By expelling an air vortex ring from the air vortex ring generator towards the volume in which the sheet is flipping on top of the stack on the receiving member, a flipping sheet is assisted in its flipping movement in a controlled fashion. By means of the temporal stability of an air vortex ring the direction and energy of the air vortex ring are very controllable.

In another embodiment of the device according to the invention, the translational direction of the generated vortex ring extends substantially parallel to the receiving member. By expelling an air vortex ring substantially parallel to the imaginary plane of the receiving member a sheet is assisted to roll off on top of the stack of one or more sheets on the receiving member by the directional impulse from the air vortex ring onto the flipping sheet.

In another embodiment of the device according to the invention, the sheet flipping device comprises a first and a second vortex ring generator, having respectively a first and second translational direction of a first and second in operation generated air vortex ring. Using two air vortex ring generators may contribute to a less complex configuration by mounting an air vortex ring generators on both sides of the flipping element.

In a further embodiment the device according to the invention, the first and second translational directions are angled towards each other. By mounting the first and second air vortex ring generators on both sides from the flipping wheel unit the complexity of placing an air vortex ring generator in between the flipping wheel unit thereby introducing additional complexity to the system. However, in a preferred embodiment the air vortex rings operate on the flipping sheet in a symmetrical fashion to contribute to the stacking quality. By aiming both air vortex ring generators slightly inward the effect of both air vortex ring generators is increased in the volume in which the sheet is performing its flipping motion form the flipping element onto the top of the stack of one or more sheets on the receiving member.

In a further embodiment of the device according to the invention, the first and second translational directions intersect within the flipping volume. By aiming both air vortex ring generators slightly inward the effect of both air vortex ring generators is increased in the volume in which the sheet is performing its flipping motion form the flipping element onto the top of the stack of one or more sheets on the receiving member.

In another aspect of the present invention, a sheet stacking device and a printing device are provided, comprising such a sheet flipping device with an air vortex ring generator as defined here above. Whereas processing speeds of stacking devices increase more and more, the requirements for stacking quality do not decrease. In addition, the expected ranges of media to be processed also broaden. Therefore also larger, thinner and more floppy sheets should be processed and stacked as fast as possible with a stack quality, in particular the straightness of a stack, must be maintained. When air flow is increased, e.g. by applying fans to assist sheets during their flipping motion the registration of the stack and therefore the stack quality may decrease significantly. Applying air vortex ring generators introduce additional control over air flow, timing and direction of the sheet assisting forces.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
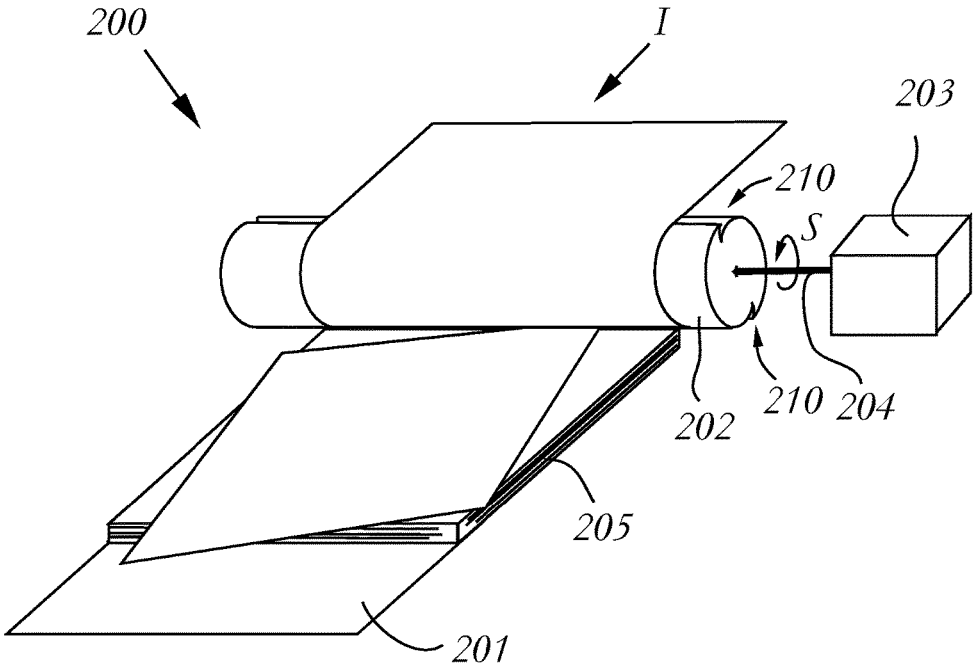
FIG. 1 is a schematic perspective view showing a prior art sheet stacking device.

The present invention will now be described with reference to the accompanying drawings, wherein the same reference numerals have been used to identify the same or similar elements throughout the several views.

FIG. 1 is a schematic perspective view showing a prior art sheet stacking device. This sheet stacking device 200 comprises a receiving member 201 to receive sheets to form a stack of sheets 205. The sheet stacking device further comprises a rotatable flipping element, such as a flipping wheel 202. This flipping wheel has two slits 210 arranged around its circumference. These slits 210 are devised such that sheets which are fed towards the flipping wheel 202 in input direction I and are at least partly received by the slits 210. The flipping wheel 202 is rotatably driven by means of drive motor 203 and coupled drive shaft 204. By rotating the flipping wheel 202 in rotational direction R, the sheets are flipped over and arranged on top of the receiving member 201 or previously formed stack 205. The sheet stacking device has a relative high degree of erroneous formed stacks.

Figure 2:
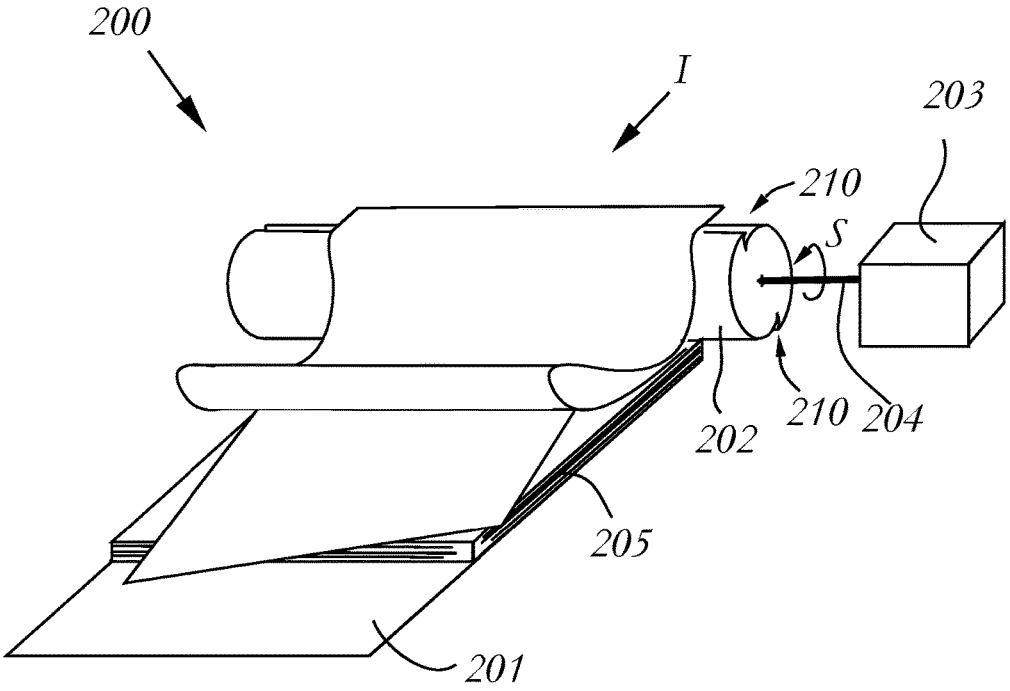
FIG. 2 is a schematic perspective view showing a prior art sheet stacking device comprising a vortex ring generator according to the invention in operation.

FIG. 2 shows a problem during operation of the prior art sheet stacking device resulting in an erroneous formed stack. The leading edge of the sheet has been received by the slit 210 and driven to be flipped. During the final part of the flipping of the sheet, the sheet has a problem rolling out onto the top of the stack 205 formed on the receiving member 201. In particular floppy sheets with relative low stiffness in the direction of rotation tend to collapse onto itself during flipping, preventing a smooth roll out onto the top of the stack 205. This results in a less well-aligned stack of sheets and may even result in the blocking of the device.

Figure 3A:
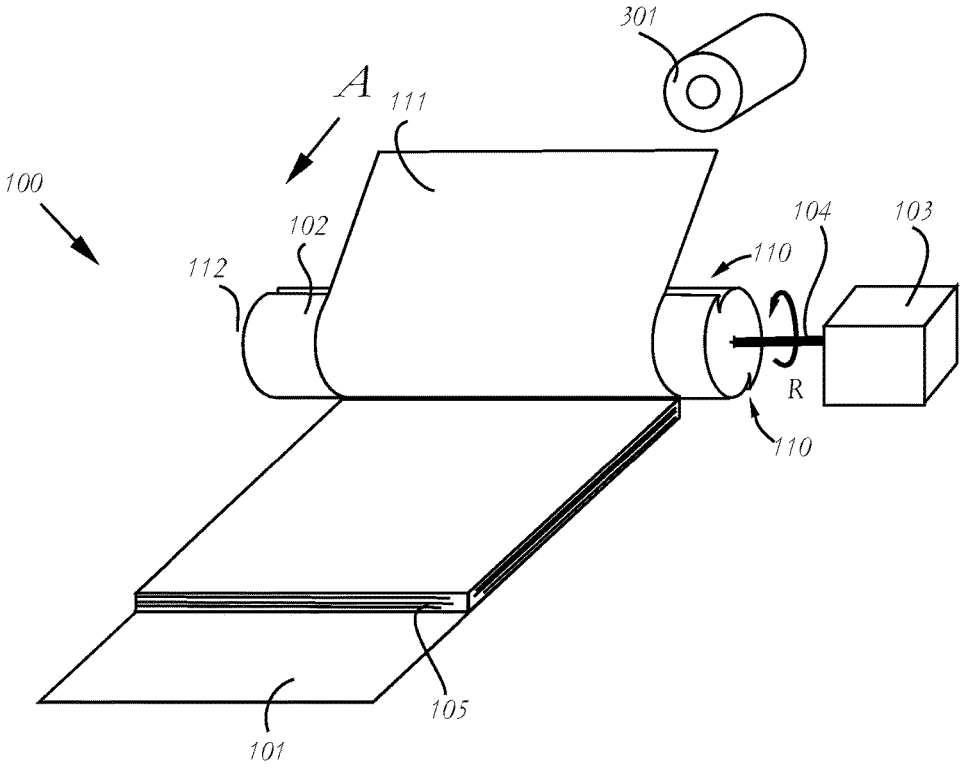
FIG. 3A is a schematic perspective view of an embodiment of a sheet stacking device comprising a vortex ring generator according to the invention.

FIG. 3A is a schematic perspective view of an embodiment of a sheet stacking device comprising a vortex ring generator according to the invention. The stacking device 100 comprises a rotatable sheet flipping wheel 102 as a sheet flipping element. This sheet flipping wheel 102 has two slits 110 at its circumference to accommodate at least a portion of an incoming sheet. The sheet flipping wheel 102 is connected to a drive motor 103 via a drive shaft 104. A sheet receiving member 101 is provided to accommodate a sheet of a stack of sheets 105. The height of the sheet receiving member 101 relative to the flipping wheel 102 is adaptable to enable an enlarged sheet accommodation capacity while sheets are controllably released onto the top of the receiving member 101 or an already formed stack of sheets 105. Alternatively the sheet receiving member 101 may have a fixed height relative to the flipping wheel 102.

The sheet flipping device is further provided with an air vortex ring generator 301 having an air vortex ring exit nozzle defining a translational direction of a generated air vortex ring when said generated vortex ring is in operation generated from the air vortex ring exit nozzle. The air vortex ring generator is mounted such that in operation the sheet is urged onto the receiving member 101 by the air vortex ring during the flipping motion of the sheet 111 through the flipping volume. The flipping volume being the volume which in operation is defined by the flipping movement of the sheet, a flipping element for flipping the sheet around an axis of rotation within the flipping volume onto the receiving member. The air vortex ring generator is mounted such that in operation the sheet 111 is assisted with a force transferred from the air vortex ring onto the receiving member during the flipping motion of the sheet through the flipping volume.

This flipping volume is the volume through which the sheet 111 is actually moved during its flipping movement in operation from its initial position to its flipped position on top of the receiving member 101 or the previously formed stack 105.

In operation an incoming sheet is fed towards the sheet flipping wheel 102 in direction A from a supply or any sheet processing unit (not shown). In the illustrated situation, the leading edge portion of sheet 111 has been accommodated in slit 110, rotated in direction of rotation R by driving the driving motor 103 for approximately a half revolution. At this point the leading edge portion of the sheet 111 is released from the slit 110 by means of an abutment (not shown) which is arranged between two segments of the flipping wheel 102. By rotating the flipping wheel 102 further, the sheet 111 will be released and accommodated on top of the previously formed stack 105 in a flipped orientation with respect to its original orientation.

Figure 3B:
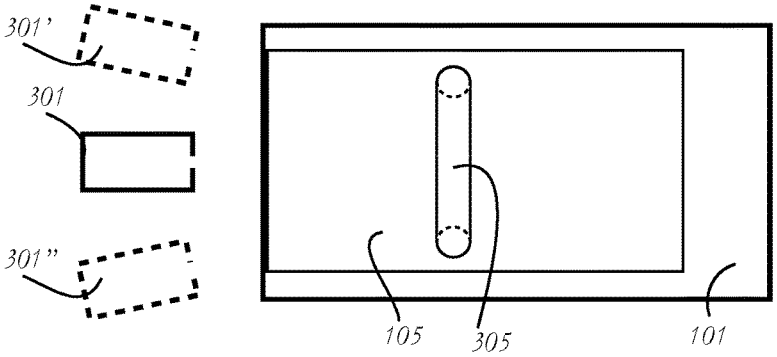
FIG. 3B is a schematic top view of a sheet stacking device comprising a vortex ring generator according to the invention.

FIG. 3B is a schematic top view of a sheet stacking device comprising a vortex ring generator according to the invention. A stack of sheets 105 is formed by the subsequent feeding of individual sheets onto sheet receiving member 101. Air vortex ring generator 301 is mounted such that the generated air vortex ring 305 is ejected towards the sheet flipping volume. Alternatively more than one air vortex ring generators are mounted. As an example an embodiment with two slightly slanted air vortex ring generators 301' and 301" are shown as dashed schematic units.

Figure 4A:
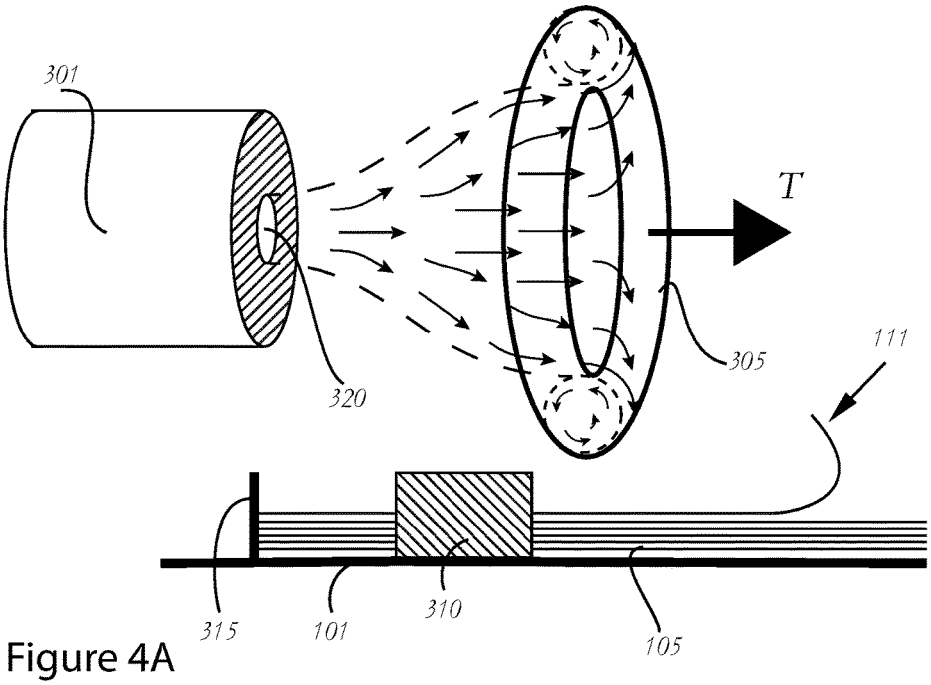
FIG. 4A is a schematic side view of embodiments of a sheet stacking device comprising a vortex ring generator according to the invention.

FIG. 4A is a schematic side view of embodiments of a sheet stacking device comprising a vortex ring generator 301 according to the invention. In this embodiment the air vortex ring generator 301 comprises an internal air chamber with a de Laval nozzle (not shown) ending in an air vortex ring nozzle 320 on the one side and an actuated moving wall (not shown) on the other side of the air chamber. An actuator mounted on the moving wall is placed in an electrical coil which can be electrically powered to push the moving wall into the air chamber, thereby expelling a volume of air through the de Laval nozzle to form an air vortex ring 305. Expelling the volume of air through the de Laval nozzle ejects a spherical pressure wave containing a substantially toroidal or poloidal flow of air. The substantially toroidal flow of air is defined by an air flow flowing in a substantially circular fashion as depicted in the dashed circles in the top and bottom of air vortex 305. The air vortex ring, or toroidal vortex is a torus shaped vortex of air spinning substantially around an imaginary axis line that forms a closed loop as shown in the top and bottom dashed areas. The air vortex ring moves in a direction T that is substantially perpendicular to the plane of the rings forming the vortex and such that the inner edges of the imaginary rings forming the vortex moves faster forward than the outer edge.

Whereas a stack of sheets 105 is formed onto sheet support surface 101 against a registration stop member 315 and against a lateral registration member 310. The expelled vortex ring 305 moving from nozzle 320 in direction T assists a smooth rolling out of sheet 111 which is depicted in a state of rolling out on top of the stack of sheets 105. By means of the energy contained in air vortex 305 a force is imposed onto sheet 111 which assists the sheet stacking by urging the sheet on top of the stack.

Figure 4B:
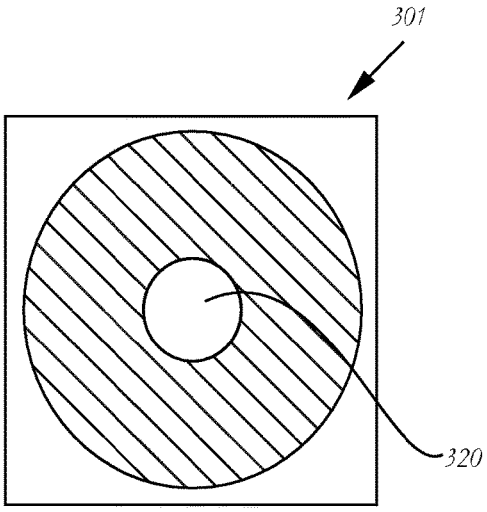
FIG. 4B is a schematic front view of embodiments of a vortex ring generator according to the invention.

FIG. 4B is a schematic front view of embodiments of a vortex ring generator according to the invention. The air vortex ring generator unit 301 comprises a nozzle 320 which is the end point of the De Laval nozzle which connects the air chamber with the nozzle 320.

Figure 4C:
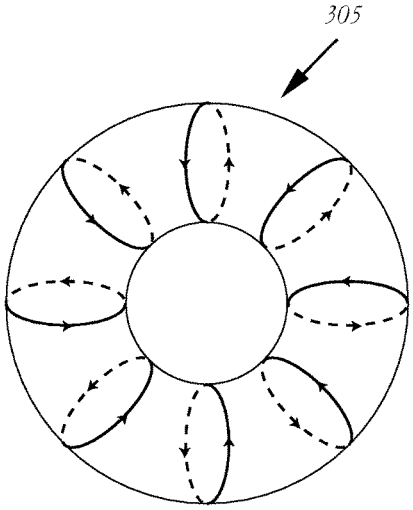
FIG. 4C is a schematic impression of a vortex ring as generated in a vortex ring generator according to the invention.

FIG. 4C is a schematic impression of a vortex ring 305 as generated in a vortex ring generator according to the invention. The dominant flow of air in the air vortex ring 305 is locally circular shaped to define a toroid ring of imaginary rings of air.

Figure 5:
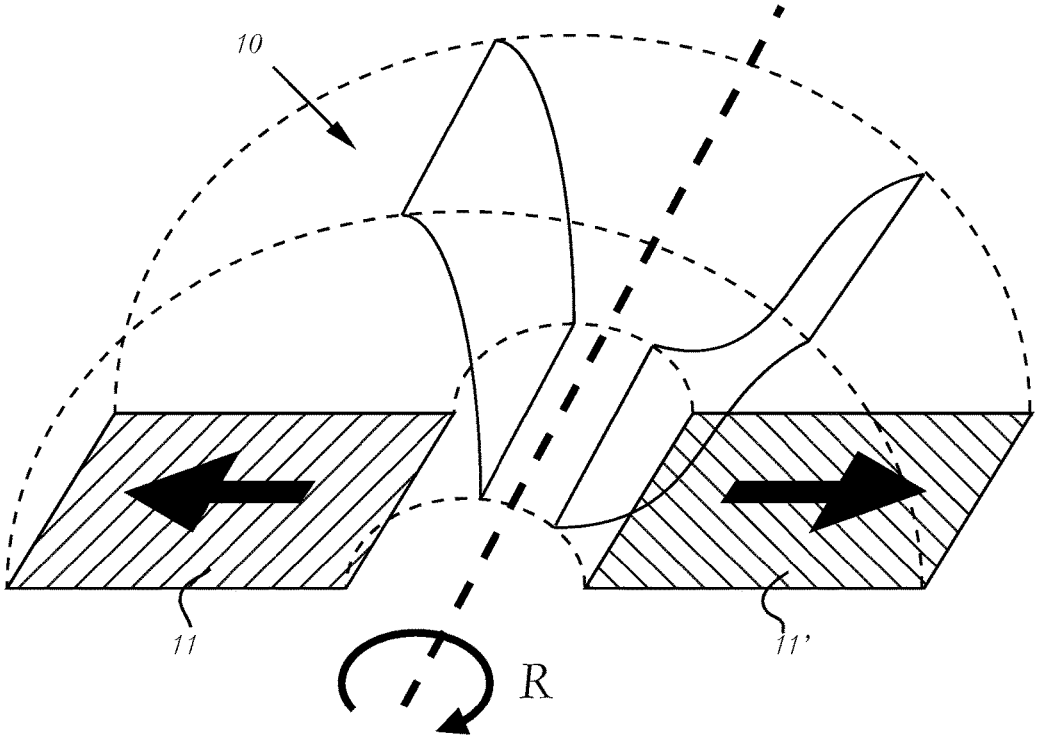
FIG. 5 is a schematic view showing a flipping sheet in the flipping volume.

FIG. 5 is a schematic view showing a flipping sheet in the flipping volume. A sheet 11 that is flipped using a sheet flipping device according to the invention (not shown) is moved through a flipping volume 10. This flipping volume 10 is the volume through which the sheet 11 is actually moved during its flipping movement in operation from its initial position 11 to its flipped position 11'. The flipping element (not shown) flips the sheet 11 around axis of rotation, indicated as the dashed bold line in rotational direction R. The flipping volume 10 is span by the accumulated positions of the sheet 11 during its flipping movement towards position 11'. The flipping volume 10 is indicated by means of the dashed lined volume.

In the flipping device according to the invention, the discharge elements are arranged adjacent to the flipping volume. In practise a variety of sheet sizes may be processed and stacked. Therefore the discharge elements are generally arranged adjacent to the flipping volume of the sheet size with the largest width. If the end portions of the electrodes are sharp enough, the electrodes will still enable a discharge to smaller sheet sizes.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet flipping device, comprising:

a receiving member for receiving a sheet, a flipping volume being the volume which in operation is defined by the flipping movement of the sheet;

a flipping element for flipping the sheet around an axis of rotation within the flipping volume onto the receiving member; and an air vortex ring generator having an air vortex ring exit nozzle and an actuator for expelling a volume of air through the air vortex ring exit nozzle to form an air vortex ring moving in a translational direction, wherein the air vortex ring generator is mounted such that the translational direction extends along the receiving member, such that in operation the sheet is urged onto the receiving member by a formed air vortex ring moving along the receiving member during the flipping motion of the sheet through the flipping volume.

2. The sheet flipping device according to claim 1, wherein the sheet flipping device comprises a first and a second vortex ring generator, having respectively a first and second translational direction of a first and second in operation generated air vortex ring.

3. The sheet flipping device according to claim 2, wherein the first and second translational direction are angled towards each other.

4. The sheet flipping device according to claim 3, wherein the first and second translational direction intersect within the flipping volume.

5. A sheet stacking device, comprising the sheet flipping device according to claim 1.

6. A printing apparatus comprising the sheet flipping device according to claim 1.

7. A sheet flipping device, comprising:

a receiving member for receiving a sheet, a flipping volume being the volume which in operation is defined by the flipping movement of the sheet;

a flipping element for flipping the sheet around an axis of rotation within the flipping volume onto the receiving member; and an air vortex ring generator having an air vortex ring exit nozzle and an actuator for expelling a volume of air through the air vortex ring exit nozzle to form an air vortex ring moving in a translational direction, wherein the air vortex ring generator is mounted such that the translational direction extends along the receiving member, such that in operation the sheet is urged onto the receiving member by a formed air vortex ring moving along the receiving member during the flipping motion of the sheet through the flipping volume, and wherein the translational direction extends substantially parallel to the receiving member.

8. A sheet flipping device, comprising:

a receiving member for receiving a sheet, a flipping volume being the volume which in operation is defined by the flipping movement of the sheet;

a flipping element for flipping the sheet around an axis of rotation within the flipping volume onto the receiving member; and an air vortex ring generator having an air vortex ring exit nozzle and an actuator for expelling a volume of air through the air vortex ring exit nozzle to form an air vortex ring moving in a translational direction, wherein the air vortex ring generator is mounted such that the translational direction extends along the receiving member, such that in operation the sheet is urged onto the receiving member by a formed air vortex ring moving along the receiving member during the flipping motion of the sheet through the flipping volume, wherein the sheet is assisted to roll off on top of the stack of one or more sheets on the receiving member by a directional impulse from the air vortex ring onto the sheet.

* * * * *